US010544027B2

(12) United States Patent
Gatipon et al.

(10) Patent No.: US 10,544,027 B2
(45) Date of Patent: Jan. 28, 2020

(54) BEVERAGE DISPENSING SYSTEM WITH RECIRCULATION LOOP HEAT EXCHANGE ASSEMBLY

(71) Applicant: The Coca-Cola Company, Atlanta, GA (US)

(72) Inventors: Shaun B. Gatipon, Kennesaw, GA (US); Adam Daniel Ambrecht, Kennesaw, GA (US); Kirk William Charles, Austell, GA (US); Craig Jay Cochran, Atlanta, GA (US); Christopher Ross Vickers, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 16/069,267

(22) PCT Filed: Dec. 22, 2016

(86) PCT No.: PCT/US2016/068310
§ 371 (c)(1),
(2) Date: Jul. 11, 2018

(87) PCT Pub. No.: WO2017/123402
PCT Pub. Date: Jul. 20, 2017

(65) Prior Publication Data

US 2019/0031487 A1 Jan. 31, 2019

Related U.S. Application Data

(60) Provisional application No. 62/277,514, filed on Jan. 12, 2016.

(51) Int. Cl.
*B67D 1/08* (2006.01)
*B67D 1/10* (2006.01)

(52) U.S. Cl.
CPC ..... *B67D 1/0867* (2013.01); *B67D 1/10* (2013.01)

(58) Field of Classification Search
CPC ..... B67D 1/0867; B67D 1/00; B67D 1/0021; B67D 1/0054; B67D 1/0865; B67D 1/10; B67D 2001/0095; B67D 1/0861
(Continued)

(56) References Cited

U.S. PATENT DOCUMENTS 4,730,463 A 3/1988 Stanfill
4,886,525 A 12/1989 Hoover
(Continued)

FOREIGN PATENT DOCUMENTS

WO 02066365 A1 8/2002

OTHER PUBLICATIONS

International Search Report and Written Opinion, PCT/US2016/068301, Apr. 4, 2017 (11 pp.).

*Primary Examiner* — Benjamin R Shaw
(74) *Attorney, Agent, or Firm* — Eversheds Sutherland (US) LLP

(57) ABSTRACT

The present application thus provides a beverage dispensing system for combining a macro-ingredient flow and a carbonated water flow. The beverage dispensing system may include a nozzle, a carbonated water source in communication with the nozzle via a carbonated water conduit and a carbonated water recirculation conduit, a macro-ingredient source in communication with the nozzle via a macro-ingredient conduit, and a macro-ingredient pump and an air chamber in communication with the macro-ingredient conduit. The carbonated water recirculation conduit is in communication with the air chamber for heat exchange therewith.

18 Claims, 5 Drawing Sheets

(58) Field of Classification Search
USPC ..... 222/146.6
See application file for complete search history.

(56) References Cited

U.S. PATENT DOCUMENTS

| | | | | |
|---|---|---|---|---|
| 5,335,819 | A * | 8/1994 | Martin | B67D 1/06 222/129.1 |
| 5,392,960 | A * | 2/1995 | Kendt | B67D 1/06 222/129.1 |
| 6,431,403 | B1 * | 8/2002 | Davis | B67D 1/0054 222/146.6 |
| 2002/0189276 | A1 * | 12/2002 | Davis | B67D 1/0012 62/393 |
| 2004/0045983 | A1 * | 3/2004 | McCann | B67D 1/0021 222/146.6 |
| 2004/0123619 | A1 * | 7/2004 | McCann | B67D 1/0021 62/390 |
| 2005/0011910 | A1 * | 1/2005 | McCann | B67D 1/0021 222/146.6 |
| 2012/0228328 | A1 | 9/2012 | Ryan et al. | |
| 2018/0044157 | A1 * | 2/2018 | Cohen | B67D 1/0021 |
| 2018/0044161 | A1 * | 2/2018 | Moore | B67D 1/0885 |

* cited by examiner

BEVERAGE DISPENSING SYSTEM WITH RECIRCULATION LOOP HEAT EXCHANGE ASSEMBLY

TECHNICAL FIELD

The present application and the resulting patent relate generally to beverage dispensing systems and more particularly relate to beverage dispensing systems with a recirculation loop heat exchange assembly to maintain fluids therein a chilled condition during periods of inactivity.

BACKGROUND OF THE INVENTION

Conventional post-mix beverage dispensers generally mix streams of syrup, concentrate, sweetener, bonus flavors, other types of flavoring, and other ingredients with water or other types of diluents. Preferably, the beverage dispenser may provide as many types and flavors of beverages as may be possible in a footprint that may be as small as possible. Recent improvements in beverage dispensing technology have focused on the use of micro-ingredients. With micro-ingredients, the traditional beverage bases may be separated into a number of constituent parts at much higher dilution or reconstitution ratios. A beverage dispenser using micro-ingredients thus may provide the customer with many more beverage options as compared to a conventional beverage dispenser.

Depending upon the intended location for the beverage dispenser and/or other considerations, some or all of the fluids used in the beverage dispenser may be stored at a distance from the beverage dispenser and/or from the dispensing nozzle. For example, the sweetener may be stored in a conventional bag-in-box at a distance from the beverage dispenser. The flow of sweetener and/or other types of fluids may pass through a chiller that is remote from the beverage dispenser and/or the dispensing nozzle so as to keep the fluids chilled.

Although the remote chiller may chill the flow of sweetener and/or other fluids to the appropriate temperature, the flow of sweetener and/or other fluids in the conduits between the remote chiller and the beverage dispenser may, over periods of inactivity, warm to an undesirable temperature. As a result, the first several beverages after such a period of inactivity may be unacceptable to the consumer as the warmer fluids are dispensed.

SUMMARY OF THE INVENTION

The present application thus provides a beverage dispensing system for combining a macro-ingredient flow and a carbonated water flow. The beverage dispensing system may include a nozzle, a carbonated water source in communication with the nozzle via a carbonated water conduit and a carbonated water recirculation conduit, a macro-ingredient source in communication with the nozzle via a macro-ingredient conduit, and a macro-ingredient pump and an air chamber in communication with the macro-ingredient conduit. The carbonated water recirculation conduit is in communication with the air chamber for heat exchange therewith.

The present application and the resultant patent further may describe a method of providing a chilled beverage from a macro-ingredient and carbonated water. The method may include the steps of chilling a source of the macro-ingredient and a source of the carbonated water, intermittently flowing the macro-ingredient to a nozzle, circulating the carbonated water between the nozzle and the carbonated water source, and exchanging heat with the intermittent flow of the macro-ingredient and the circulating carbonated water.

The present application and the resultant patent further may provide a beverage dispensing system for combining a macro-ingredient flow and a carbonated water flow. The beverage dispensing system may include a nozzle, a dispensing tower with a tower bundle assembly, a carbonated water source in communication with the nozzle via a carbonated water conduit and a carbonated water recirculation conduit, and a macro-ingredient source in communication with the nozzle via a macro-ingredient conduit. The tower bundle assembly may include a tower bundle conduit with the carbonated water conduit, the carbonated water recirculation conduit, and the macro-ingredient conduit positioned therein.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
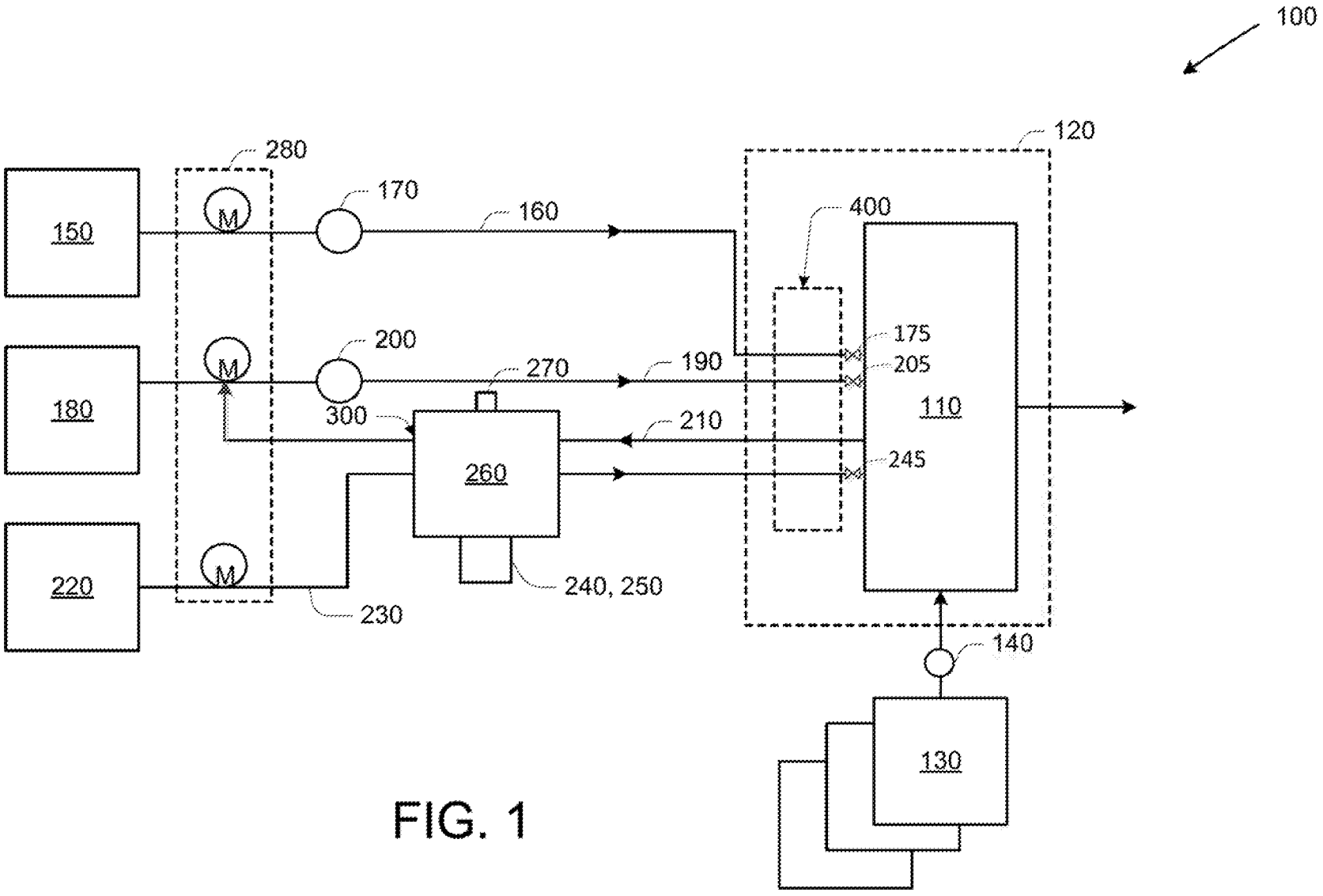
FIG. 1 is a schematic diagram example of a beverage dispensing system as may be described herein.

Referring now to the drawings, in which like numerals refer to like elements throughout the several views, FIG. 1 shows an example of a beverage dispensing system 100 as is described herein. The beverage dispensing system 100 may be used for dispensing many different types of beverages or other types of fluids. Specifically, the beverage dispensing system 100 may be used with diluents, macro-ingredients, micro-ingredients, and other types of fluids. The diluents generally include plain water (still water or non-carbonated water), carbonated water, and other fluids. Any type of fluid may be used herein.

Generally described, the macro-ingredients may have reconstitution ratios in the range from full strength (no dilution) to about six (6) to one (1) (but generally less than about ten (10) to one (1)). The macro-ingredients may include sugar syrup, HFCS ("High Fructose Corn Syrup"), concentrated extracts, purees, and similar types of ingredients. Other ingredients may include dairy products, soy, and rice concentrates. Similarly, a macro-ingredient base product may include the sweetener as well as flavorings, acids, and other common components as a beverage syrup. The beverage syrup with sugar, HFCS, or other macro-ingredient base products generally may be stored in a conventional bag-in-box container remote from the dispenser. The viscosity of the macro-ingredients may range from about 1 to about 10,000 centipoise and generally over 100 centipoises when chilled. Other types of macro-ingredients and the like may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of ingredients. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

The various fluids used herein may be mixed in or about a dispensing nozzle 110. The dispensing nozzle 110 may be a conventional multi-flavor nozzle and the like. The dispensing nozzle 110 may have any suitable size, shape, or configuration. The dispensing nozzle 110 may be positioned within a dispensing tower 120. The dispensing tower 120 made have any suitable size, shape, or configuration. The dispensing tower 120 may extend from a countertop and the like and/or the dispensing tower 120 may be a free-standing structure. The dispensing tower 120 may have a number of the dispensing nozzles 110 thereon.

The micro-ingredients may be stored in a number of micro-ingredient containers 130 or other types of micro-ingredient sources. The micro-ingredient containers 130 may have any suitable size, shape, or configuration. Any number of the micro-ingredient containers 130 may be used herein. The micro-ingredient containers 130 may be in communication with the dispensing nozzle 110 via a number of micro-ingredient pumps 140. The micro-ingredient pumps 140 may be any type of conventional fluid moving device and made have any suitable volume or capacity. The micro-ingredient containers 130 may be positioned adjacent to or remote from the dispensing nozzle 110. The micro-ingredient containers 130 may be positioned under the counter top upon which the dispensing tower 120 rests.

A still water source 150 may be in communication with the dispensing nozzle 110 via a still water conduit 160. Other types of diluents may be used herein. Still water or other types of diluents may be pumped to the dispensing nozzle 110 via a still water pump 170. The still water pump 170 may be may be any type of conventional fluid moving device and made have any suitable volume or capacity. Any number of still water sources 150 may be used herein. One or more still water flow valves 175 may be used herein.

A carbonated water source 180 may be in communication with the dispensing nozzle 110 via a carbonated water conduit 190. The carbonated water source 180 may be a conventional carbonator and the like. The carbonator may have any suitable size, shape, or configuration. Carbonated water or other types of diluents may be pumped to the dispensing nozzle 110 via a carbonated water pump 200. The carbonated water pump 200 may be any type of conventional fluid moving device and made have any suitable volume or capacity. Any number of carbonated water sources 180 may be used herein. One or more carbonated water flow valves 205 may be used herein.

A carbonated water recirculation line 210 may extend from the dispensing nozzle 110 back towards the carbonated water source 180. Specifically, the carbonated water flow may be recirculated periodically or continuously between the dispensing nozzle 110 and a remote chiller as will be described in more detail below. The use of the carbonated water recirculation line 210 insures that the carbonated water flow maintains the desired temperature and the desired level of carbonation therein.

One or more macro-ingredient sources 220 may be in communication with the dispensing nozzle 110 via one or more macro-ingredient conduits 230. The macro-ingredient sources 220 may include sweeteners such as high fructose corn syrup, sugar solutions, and the like. The macro-ingredient sources 220 may be a conventional bag-in-box or other type of container in any suitable size, shape, or configuration. Any number of the macro-ingredient sources 220 may be used herein.

The macro-ingredients may flow to the dispensing nozzle 110 via a macro-ingredient pump 240 and one or more macro-ingredient flow valves 245. In this case, the macro-ingredient pump 240 may be a controlled gear pump 250 and the like. The controlled gear pump 250 may accommodate the higher viscosity typically found with the use of high fructose corn syrup and the like. The controlled gear pump 250 may be a reversible, variable speed pump and may have of suitable volume or capacity. The controlled gear pump 250 may be used with an air chamber 260. The air chamber 260 may have any suitable size, shape, or configuration. The air chamber 260 allows the macro-ingredients to flow into either a top end or a bottom end thereof. The use of the reversible controlled gear pump 250 allows fluid to be pumped into the bottom end thereof so as to force any unwanted air through an upper air vent 270. An example of an air chamber 260 with a reversible controlled gear pump 250 is shown in commonly owned International Application Number PCT/US15/028559, entitled "Vacuum Side Air Vent", filed on Apr. 30, 2015. International Application Number PCT/US15/028559 is incorporated herein by reference in full. Other components and configurations may be used herein.

To the extent that the still water source 150, the carbonated water source 180, and/or the macro-ingredient source 220 are positioned at a distance from the dispensing nozzle 110, the still water, the carbonated water, and/or the macro-ingredients may be stored in and/or flow through a remote chiller 280. The remote chiller 280 may be of conventional design and may have any suitable size, shape, or configuration. The remote chiller 280 may chill the fluids therein to a predetermined temperature. The various conduits 160, 190, 210, and 230 may extent through an insulated conduit between the remote chiller 280 and the dispensing tower 12 Other components and other configurations may be used herein.

Figure 2:
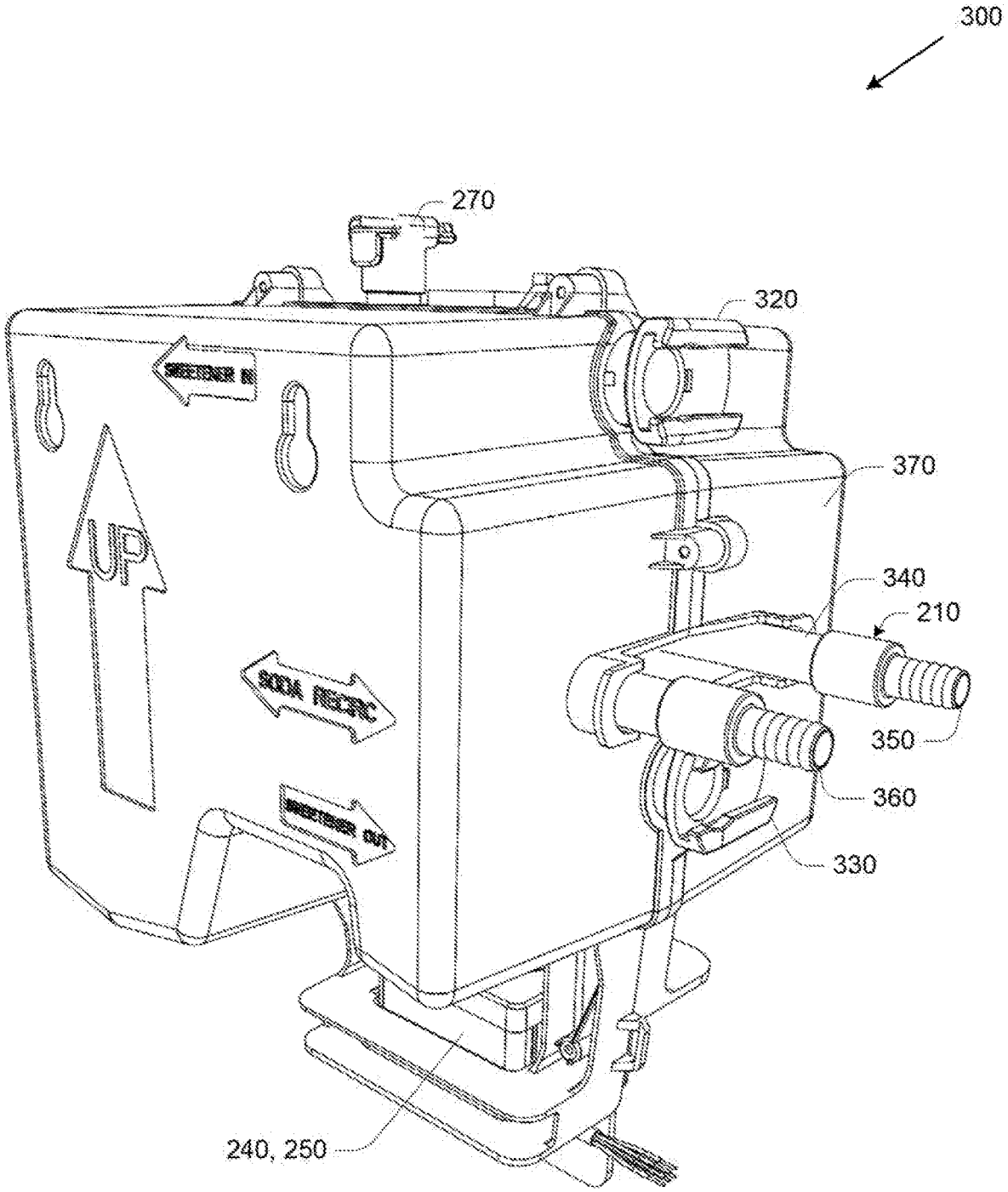
FIG. 2 is a prospective view of a recirculation loop heat exchange assembly as may be described herein.
Figure 3:
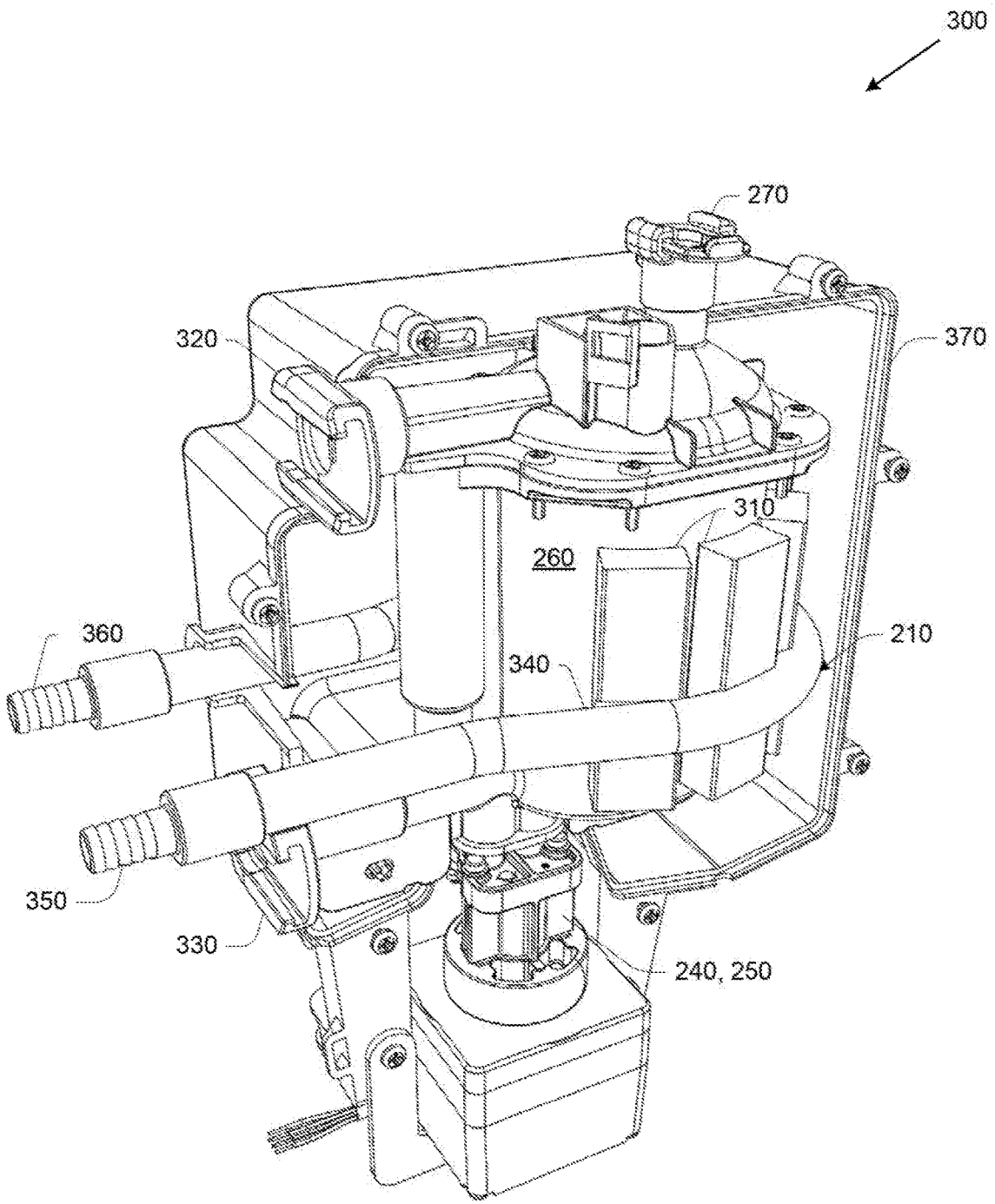
FIG. 3 is a partial sectional view of the recirculation loop heat exchange assembly of FIG. 2.
Figure 4:
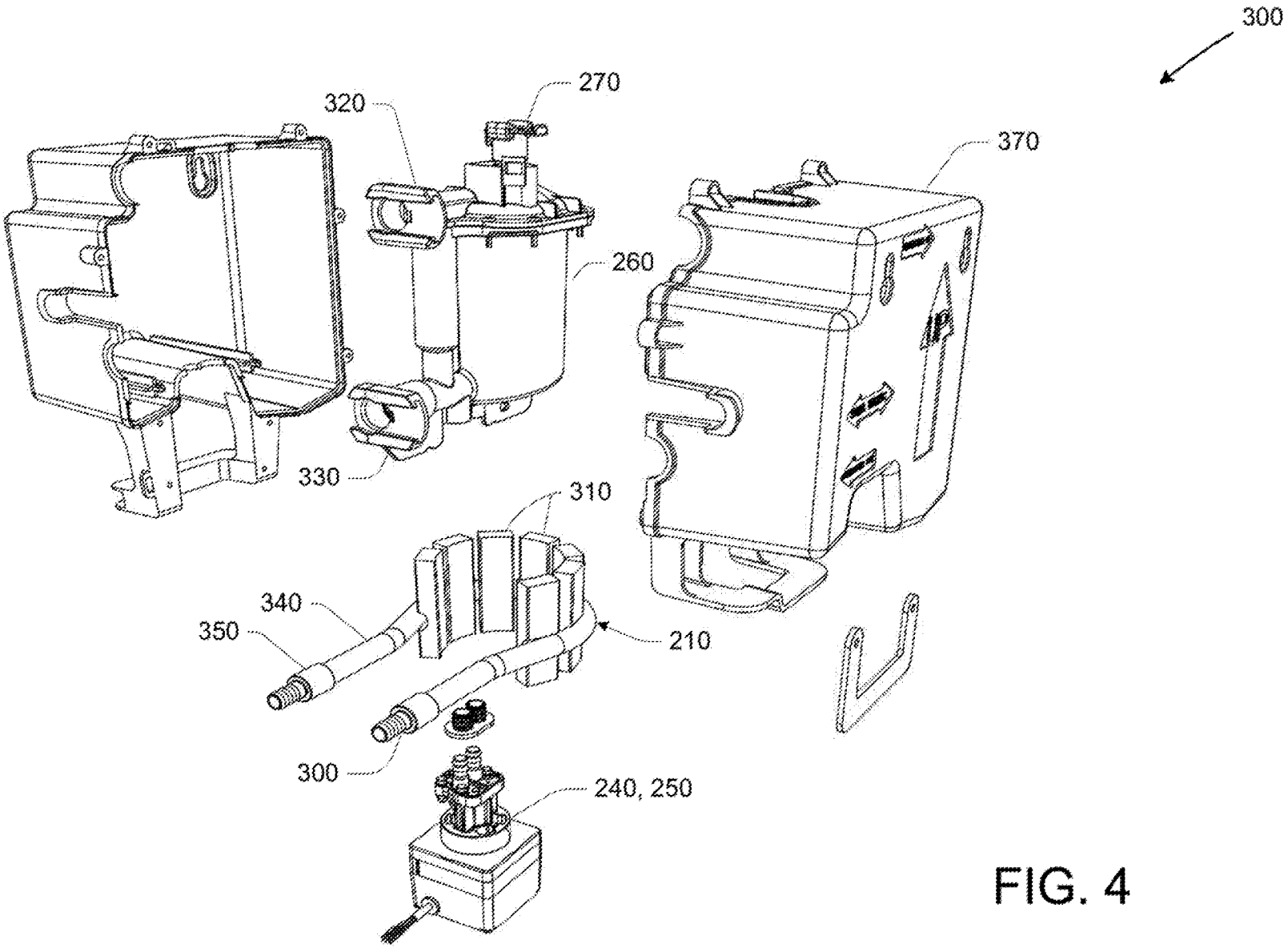
FIG. 4 is an exploded view of the recirculation loop heat exchange assembly of FIG. 2.

FIGS. 2-4 show a recirculation loop heat exchange assembly 300 that may be used with the beverage dispensing system 100. The recirculation loop heat exchange assembly 300 may include the carbonated water recirculation conduit 210, the controlled gear pump 250, and the air chamber 260 as described above positioned therein. The carbonated water recirculation conduit 210 may encircle the air chamber 260 in whole or in part. The carbonated water recirculation conduit 210 may be in thermal communication with the air chamber 260 via a number of heat transfer bars 310. The heat transfer bars 310 likewise may encircle the air chamber 260 in whole or in part. The heat transfer bars 310 may be made out of any material with good heat transfer characteristics. The heat transfer bars 310 may have any suitable size, shape, or configuration. Likewise, the carbonated water recirculation conduit 210 and the air chamber 260 may be made out of materials with good heat transfer characteristics in whole or in part.

The air chamber 260 may extend from a macro-ingredient input port 320 to a macro-ingredient output port 330. Likewise, the carbonated water recirculation conduit 210 include an internal conduit 340 extending from recirculation input port 350 to recirculation output port 360. Alternatively, the carbonated water recirculation conduit 210 may be continuous in whole or in part. The recirculation loop heat exchange assembly 300 may include an outer casing 370. The outer casing 370 may have any suitable size, shape, or configuration. A volume of insulating foam and the like may be pumped into the outer casing 370 so as to prevent heat transfer loses. Other components and configurations may be used herein.

In use, the recirculation loop heat exchange assembly 300 maintains the volume of the macro-ingredient within the air chamber 260 in a chilled condition due to the recirculating flow of carbonated water within the carbonated water recirculation conduit 210. Specifically, the recirculation loop heat exchange assembly 300 provides for heat exchange between the continually chilled carbonated water in the carbonated water recirculation conduit 210 and the macro-ingredient or other fluid within the air chamber 260. The recirculation loop heat exchange assembly 300 thus limits the distance from the micro-ingredient source 220 to the dispensing nozzle 110 wherein the macro-ingredient or other fluid may gain heat during periods of inactivity.

Figure 5:
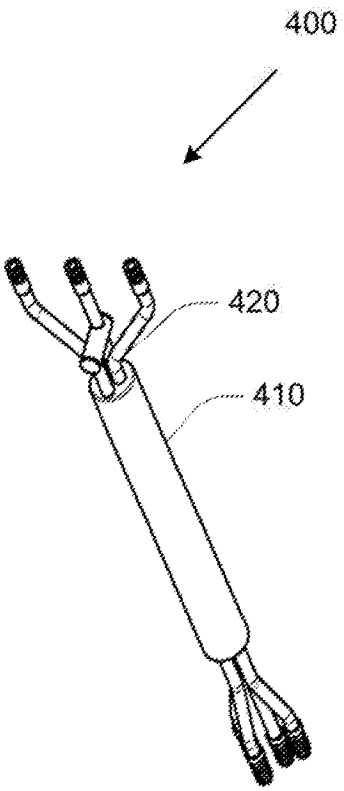
FIG. 5 is a prospective view of a tower bundle assembly as may be described herein.
Figure 6:
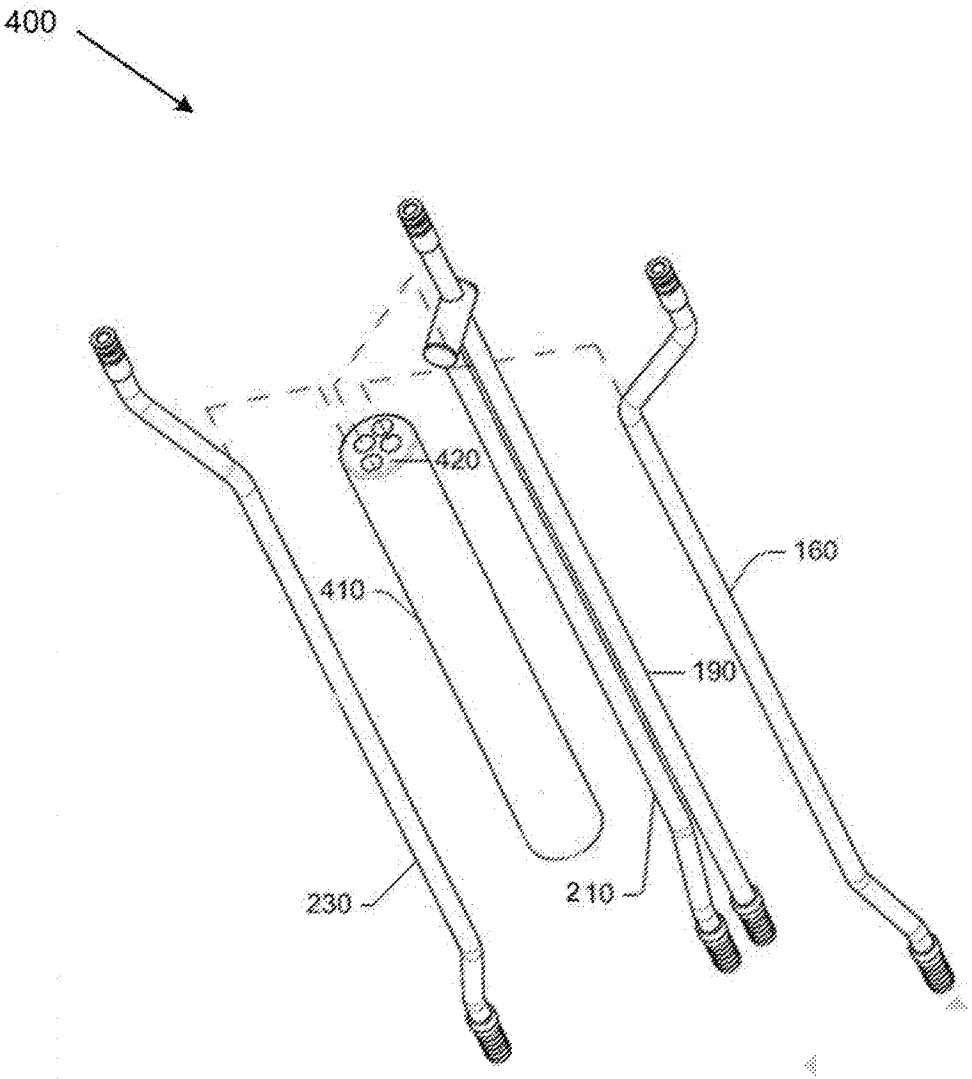
FIG. 6 is an exploded view of the tower bundle assembly of FIG. 5.

Depending upon the size of the dispensing tower 120 and/or other parameters, the macro-ingredient or other fluids also may gain heat between the recirculation loop heat exchange assembly 300 and the dispensing nozzle 110. The still water conduit 160, the carbonated water conduit 180, the carbonated water recirculation conduit 210, and the macro-ingredient conduit 230 thus may be positioned within a tower bundle assembly 400 within the dispensing tower 120. FIGS. 5 and 6 show the tower bundle assembly 400 with a tower bundle conduit 410. The tower bundle conduit 410 may be made out aluminum cast and the like. The tower bundle conduit 410 may have any suitable size, shape, and configuration and may extend for the length of the dispensing tower 120. The tower bundle assembly 400 also may include a volume of a conventional insulating foam 420. The tower bundle assembly 400 thus maintains the flow of macro-ingredients or other fluid therein in a chilled condition giving heat exchange with the carbonated water recirculation conduit 210. Other components and other configurations may be used herein.

The combination of the recirculation loop heat exchange assembly 300 and the tower bundle assembly 400 thus maintains a chilled flow of macro-ingredients or other fluids in regardless of periods of inactivity. Specifically, the recirculation loop heat exchange assembly 300 and the tower bundle assembly 400 use the recirculating flow of carbonated water to maintain the macro-ingredients or other fluids at or about the desired temperature.

It should be apparent that the foregoing relates only to certain embodiments of the present application and resulting patent. Numerous changes and modifications may be made herein by one of ordinary skill in the art without departing from the general spirit and scope of the invention as defined by the following claims and the equivalents thereof.

We claim:

1. A beverage dispensing system for combining a macro-ingredient flow and a carbonated water flow, comprising:
- a nozzle;
- a carbonated water source;
- the carbonated water source in communication with the nozzle via a carbonated water conduit and a carbonated water recirculation conduit;
- a macro-ingredient source;
- the macro-ingredient source in communication with the nozzle via a macro-ingredient conduit; and
- a macro-ingredient pump and an air chamber in communication with the macro-ingredient conduit;
- wherein the carbonated water recirculation conduit is in communication with the air chamber for heat exchange therewith.

2. The beverage dispensing system of claim 1, wherein the macro-ingredient pump comprises a controlled gear pump.

3. The beverage dispensing system of claim 1, wherein the air chamber comprises an air vent.

4. The beverage dispensing system of claim 1, further comprising a recirculation loop heat exchange assembly and wherein the macro-ingredient pump and the air chamber are positioned within the recirculation loop heat exchange assembly.

5. The beverage dispensing system of claim 4, wherein the recirculation loop heat exchange assembly comprises a plurality of heat transfer bars positioned between the carbonated water recirculation conduit and the air chamber.

6. The beverage dispensing system of claim 4, wherein the recirculation loop heat exchange assembly comprising an outer casing.

7. The beverage dispensing system of claim 6, wherein the outer casing comprises a macro-ingredient input port and a macro-ingredient output port.

8. The beverage dispensing system of claim 6, wherein the outer casing comprises recirculation input port and a recirculation output port.

9. The beverage dispensing system of claim 6, wherein the outer casing comprises a volume of foam insulation therein.

10. The beverage dispensing system of claim 1, further comprising a dispensing tower with the nozzle positioned thereon.

11. The beverage dispensing system of claim 10, wherein the dispensing tower comprises a tower bundle assembly therein.

12. The beverage dispensing system of claim 11, wherein the tower bundle assembly comprises a tower bundle conduit with the carbonated water conduit, the carbonated water recirculation conduit, and the macro-ingredient conduit positioned therein.

13. The beverage dispensing system of claim 12, wherein the tower bundle conduit has a volume of foam insulation therein.

14. The beverage dispensing system of claim 1, further comprising a remote chiller in communication with the carbonated water source and the macro-ingredient source.

15. A beverage dispensing system for combining a macro-ingredient flow and a carbonated water flow, comprising:
- a nozzle;
- the nozzle positioned about a dispensing tower;
- the dispensing tower comprising a tower bundle assembly;
- a carbonated water source;
- the carbonated water source in communication with the nozzle via a carbonated water conduit and a carbonated water recirculation conduit;
- a macro-ingredient source;

the macro-ingredient source in communication with the nozzle via a macro-ingredient conduit;

a macro-ingredient pump and an air chamber in communication with the macro-ingredient conduit and wherein the carbonated water recirculation conduit is in communication with the air chamber for heat exchange therewith; and wherein the tower bundle assembly comprises a tower bundle conduit with the carbonated water conduit, the carbonated water recirculation conduit, and the macro-ingredient conduit positioned therein.

16. The beverage dispensing system of claim 15, wherein the tower bundle conduit has a volume of foam insulation therein.

17. The beverage dispensing system of claim 15, wherein the macro-ingredient pump comprises a controlled gear pump.

18. The beverage dispensing system of claim 15, further comprising a recirculation loop heat exchange assembly and wherein the macro-ingredient pump and the air chamber are positioned within the recirculation loop heat exchange assembly.

* * * * *